US009080259B2

(12) United States Patent
Schwiegk et al.

(10) Patent No.: US 9,080,259 B2
(45) Date of Patent: Jul. 14, 2015

(54) POLYAMIDE FIBERS WITH DYEABLE PARTICLES AND PRODUCTION THEREOF

(75) Inventors: Stefan Schwiegk, Neustaft (DE); Christof Kujat, Neustadt (DE); Axel Wilms, Frankenthal (DE); Alexander Traut, Schriesheim (DE); Norbert Wagner, Mutterstadt (DE)

(73) Assignee: BASF SE, Ludwigshafen (DE)

( * ) Notice: Subject to any disclaimer, the term of this patent is extended or adjusted under 35 U.S.C. 154(b) by 80 days.

(21) Appl. No.: 13/380,344

(22) PCT Filed: Jun. 24, 2010

(86) PCT No.: PCT/EP2010/058993

§ 371 (c)(1),
(2), (4) Date: Dec. 22, 2011

(87) PCT Pub. No.: WO2011/000772

PCT Pub. Date: Jan. 6, 2011

(65) Prior Publication Data

US 2012/0108710 A1 May 3, 2012

(30) Foreign Application Priority Data

Jun. 30, 2009 (EP) ..... 09164087

(51) Int. Cl.

| | |
|---|---|
| ***C08L 83/02*** | (2006.01) |
| ***C08K 5/00*** | (2006.01) |
| ***C08L 83/00*** | (2006.01) |
| ***B32B 27/30*** | (2006.01) |
| ***D01F 6/60*** | (2006.01) |
| ***D01F 1/10*** | (2006.01) |

(52) U.S. Cl.
CPC ... *D01F 6/60* (2013.01); *D01F 1/10* (2013.01)

(58) Field of Classification Search
CPC ..... D01F 1/00; D01F 6/60; C09C 3/006; C09C 3/048; C09C 3/08
See application file for complete search history.

(56) References Cited

U.S. PATENT DOCUMENTS

| | | | | |
|---|---|---|---|---|
| 2,071,250 | A | 2/1937 | Carothers | |
| 2,071,251 | A | 2/1937 | Carothers | |
| 2,130,523 | A | 9/1938 | Carothers | |
| 2,130,948 | A | 9/1938 | Carothers | |
| 2,241,322 | A | 5/1941 | Hanford | |
| 2,312,966 | A | 3/1943 | Hanford | |
| 2,512,606 | A | 6/1950 | Bolton et al. | |
| 3,393,210 | A | 7/1968 | Speck | |
| 4,537,949 | A | 8/1985 | Schmidt et al. | |
| 4,540,772 | A | 9/1985 | Pipper et al. | |
| 6,194,538 | B1 | 2/2001 | Weiss et al. | |
| 6,699,960 | B1 | 3/2004 | Ohlbach et al. | |
| 7,048,771 | B2 * | 5/2006 | Sun et al. | 8/637.1 |
| 2003/0023028 | A1 * | 1/2003 | Tanaka et al. | 528/310 |
| 2004/0099975 | A1 * | 5/2004 | Wu et al. | 264/4.1 |
| 2006/0235191 | A1 | 10/2006 | Deininger et al. | |
| 2007/0270531 | A1 | 11/2007 | Bossennec et al. | |
| 2010/0152324 | A1 | 6/2010 | Bossennec et al. | |
| 2010/0310853 | A1 | 12/2010 | Schwiegk et al. | |
| 2011/0014492 | A1 | 1/2011 | Joshi et al. | |
| 2011/0049411 | A1 | 3/2011 | Ulanova et al. | |
| 2011/0073814 | A1 | 3/2011 | Nordmann et al. | |
| 2011/0076416 | A1 | 3/2011 | Klipp et al. | |
| 2011/0086231 | A1 | 4/2011 | Lochtman et al. | |
| 2011/0099991 | A1 | 5/2011 | Stefan et al. | |
| 2011/0204382 | A1 | 8/2011 | Traut et al. | |
| 2011/0245391 | A1 | 10/2011 | Karpov et al. | |
| 2011/0245392 | A1 | 10/2011 | Karpov et al. | |
| 2011/0250438 | A1 | 10/2011 | Haberecht et al. | |
| 2011/0266497 | A1 | 11/2011 | Eling et al. | |
| 2012/0055576 | A1 | 3/2012 | Prusty et al. | |
| 2012/0087823 | A1 | 4/2012 | Joshi et al. | |
| 2012/0108710 | A1 | 5/2012 | Schwiegk et al. | |
| 2012/0214904 | A1 | 8/2012 | Prusty et al. | |
| 2012/0217681 | A1 | 8/2012 | Zieba et al. | |

FOREIGN PATENT DOCUMENTS

| | | | |
|---|---|---|---|
| CA | 1076743 | A1 | 4/1980 |
| DE | 14 95 198 | A1 | 2/1969 |
| DE | 25 58 480 | A1 | 7/1977 |
| DE | 44 13 177 | A1 | 10/1995 |
| DE | 10313681 | A1 | 10/2004 |
| EP | 0038094 | A2 | 10/1981 |
| EP | 0038582 | A2 | 10/1981 |
| EP | 0039524 | A1 | 11/1981 |
| EP | 129195 | A2 | 12/1984 |
| EP | 129196 | A2 | 12/1984 |
| EP | 299444 | A2 | 1/1989 |
| EP | 0379470 | A2 | 7/1990 |
| EP | 922065 | A2 | 6/1999 |
| EP | 1198491 | A1 | 4/2002 |
| GB | 1113357 | A | 5/1968 |
| JP | 46-011269 | B | 3/1971 |
| JP | H02-36263 | A | 2/1990 |
| JP | 02-265966 | A | 10/1990 |
| JP | 08-232118 | A | 9/1996 |
| JP | 08-260241 | A | 10/1996 |
| JP | 11050331 | A | 2/1999 |
| JP | 2000-509420 | A | 7/2000 |

(Continued)

OTHER PUBLICATIONS

U.S. Appl. No. 61/316,848.

(Continued)

*Primary Examiner* — Susannah Chung

*Assistant Examiner* — Robert T Butcher

(74) *Attorney, Agent, or Firm* — Drinker Biddle & Reath LLP

(57) ABSTRACT

The novel polyamide fibers with dyeable particles comprise 80% to 99.95% by weight of polyamide, 0.05% to 20% by weight of dyeable particles and 0% to 19.95% by weight of added substances, the % by weight summing to 100%.

14 Claims, 2 Drawing Sheets

(56) References Cited

FOREIGN PATENT DOCUMENTS

| | | | | |
|---|---|---|---|---|
| JP | 2007-510015 | A | | 4/2007 |
| KR | 20080108751 | A | | 12/2008 |
| WO | WO 97/43335 | | * | 11/1997 |
| WO | WO-9743335 | A1 | | 11/1997 |
| WO | WO-2009147025 | A2 | | 12/2009 |
| WO | WO-2010026039 | A1 | | 3/2010 |
| WO | WO-2010043638 | A2 | | 4/2010 |
| WO | WO-2010083647 | A1 | | 7/2010 |
| WO | WO-2010083650 | A1 | | 7/2010 |
| WO | WO-2010106146 | A1 | | 9/2010 |
| WO | WO-2010115919 | A1 | | 10/2010 |
| WO | WO-2011045223 | A1 | | 4/2011 |
| WO | WO-2011054787 | A1 | | 5/2011 |
| WO | WO-2011083000 | A1 | | 7/2011 |
| WO | WO-2011120949 | A1 | | 10/2011 |

OTHER PUBLICATIONS

Technische Thermoplast Polyamide, Kunststoff Handbuch 3/4, Herausgegeben von Dr. Ludwig Bottenbruch und Dr. Rudolf Binsack, Mit 629 Bildern und 251 Tabellen, May 1977, vol. 9, No. 5.

Textile Chemist and Colorist, May 1977, vol. 9, No. 5, American Association of Textile Chemists and Colorist.

Manchester Section, Meeting held at the Grand Hotel, Manchester on Jan. 10, 1945, Dr. H. A. Thomas, Nylon Fibre: A Study of the Mechanism of the Dyeing Process with Acid Dyes, R.H. Peters.

International Search Report for PCT/EP2010/058993 mailed Sep. 28, 2010.

International Preliminary Report on Patentability for PCT/EP2010/058993 mailed Oct. 6, 2011.

English Translation of Japanese Office Action mailed on Oct. 6, 2014 for Japanese Patent Application No. 2012-518877.

* cited by examiner

GK 1924/35 chip
uncontrasted cryo
ultra thin section

TEM

POLYAMIDE FIBERS WITH DYEABLE PARTICLES AND PRODUCTION THEREOF

CROSS-REFERENCE TO RELATED APPLICATIONS

This application is a national stage application (under 35 U.S.C. §371) of PCT/EP2010/058993, filed Jun. 24, 2010, which claims.benefit of European application 09164087.0, filed Jun. 30, 2009.

The present invention relates to novel polyamide fibers with dyeable particles and processes for production thereof.

The production of fiber-grade polyamide by condensation polymerization of amide-forming monomers is known in principle (Matthies, Kunststoff-Handbuch, Volume 3/4: Polyamide, Section 2.2.1). In this condensation polymerization, the concentrations of the end groups (amino end groups, carboxyl end groups) have significant effects on the properties of a polymer.

The concentration of amino groups is of decisive importance for later dyeing of the polyamide, for example in fiber form (McGregor, Textile chemist and colorist 9, 98, (1977), Peters, J. of the Society of Dyers and Colourists 61,95 (1945), Nylon Fiber: A Study of the Mechanism of the Dyeing Process with Acid Dyes). Similarly, the stability of the melt with regard to constancy of the amino end group concentration depends significantly on the concentration and nature of the end groups (Matthies, Kunststoff-Handbuch, Volume 3/4: Polyamide, Section 2.2.1).

Furthermore, the average molecular weight attainable in the condensation polymerization and the stability of the melt in processing with regard to the average molecular weight are strongly dependent on the concentration and nature of the end groups (Matthies, Kunststoff-Handbuch, Volume 3/4: Polyamide, Section 2.2.1).

End group concentrations are typically controlled using amide-forming chain regulators, preferably carboxylic acids or amines (Matthies, Kunststoff-Handbuch, Volume 3/4: Polyamide, Section 2.2.1), which are generally introduced into the condensation polymerization mixture together with the monomeric feedstock materials, and react with the end groups of the chains, generally to form amides, so that the end groups become bound and hence unavailable for condensation or for later dyeing.

This approach has the disadvantage that a polymer's dyeability and its condensation-ability are coupled to each other and cannot be optimized independently of each other.

SUMMARY OF THE INVENTION

It is an object of the present invention to control the properties of dyeability and condensation-ability independently of each other, i.e., to develop novel and improved polyamide fibers and also processes for production thereof.

We have found that this object is achieved by novel polyamide fibers comprising dyeable particles and also processes for their production.

The novel polyamide fibers with dyeable particles comprise 80% to 99.95% by weight of polyamide, 0.05% to 20% by weight of dyeable particles and 0% to 19.95% by weight of added substances, the % by weight summing to 100%.

A BRIEF DESCRIPTION OF THE FIGURES

A DETAILED DESCRIPTION OF THE INVENTION

Figure 1:
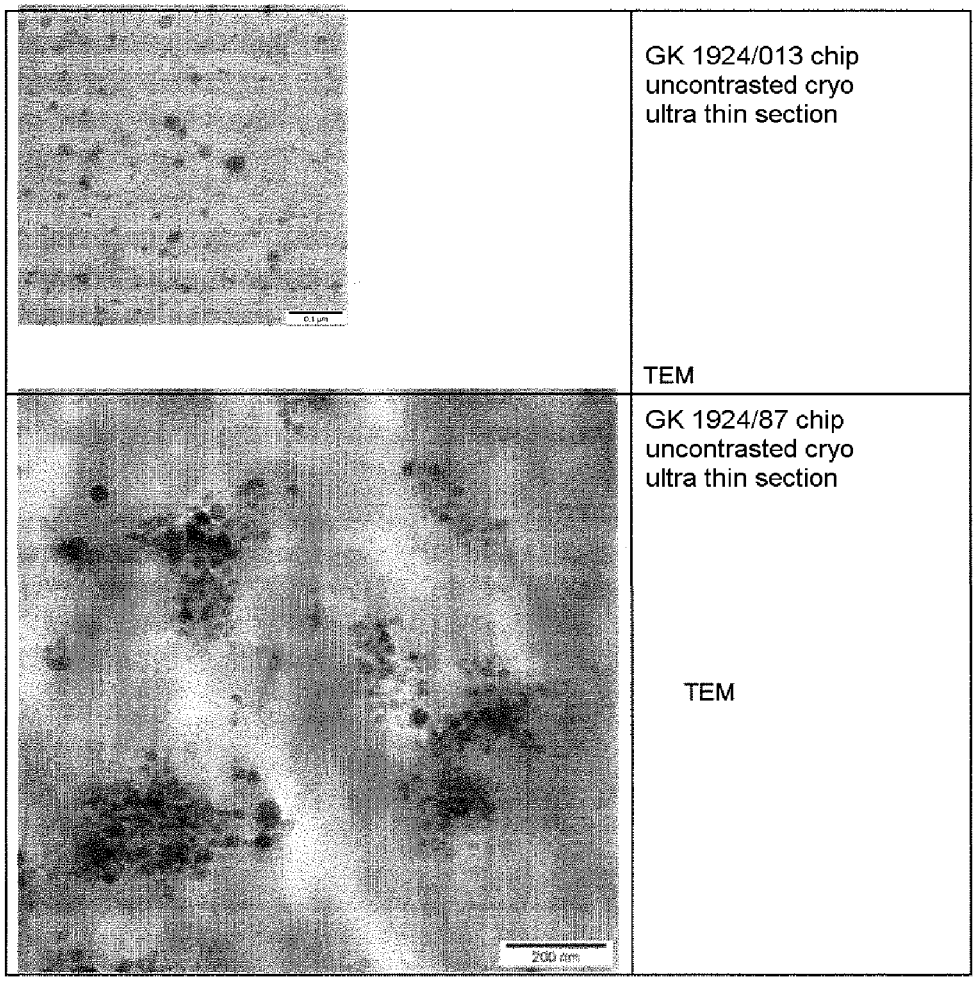
FIG. 1 illustrates the GK 1924/013 and GK 1924/87 chips uncontrasted cryo ulta thin section.
Figure 2:
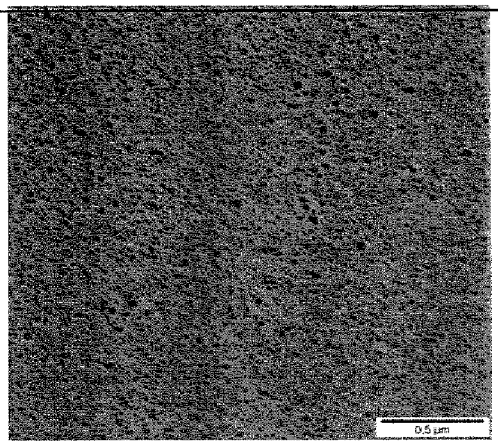
FIG. 2 illustrates the GK 1924/35 chip uncontrasted cryo ulta thin section.

Suitable polyamides A generally have a viscosity number VN of 50 to 300, preferably 100 to 200 and more preferably 120-160 ml/g, when determined in a 0.5% by weight solution of the polyamide in 96% by weight sulfuric acid at 25° C. as per ISO 307 EN.

Polyamides of aliphatic partly crystalline or partly aromatic and also amorphous construction of any kind and their blends, including polyether amides such as polyether block amides, are suitable for example.

Semicrystalline or amorphous resins having a (weight average) molecular weight of at least 5000, as described for example in U.S. Pat. Nos. 2,071,250; 2,071,251; 2,130,523; 2,130,948; 2,241,322; 2,312,966; 2,512,606; and 3,393,210, are preferred. Examples thereof are polyamides derived from lactams having 7 to 13 ring members, such as polycaprolactam, polycaprylolactam and polylaurolactam, and also polyamides obtained by reaction of dicarboxylic acids with diamines.

Useful dicarboxylic acids include alkanedicarboxylic acids having 6 to 12, in particular 6 to 10 carbon atoms and aromatic dicarboxylic acids. Adipic acid, azelaic acid, sebacic acid, dodecanedioic acid (=decanedicarboxylic acid) and terephthalic and/or isophthalic acid may be mentioned here as acids.

Useful diamines include in particular alkanediamines having 6 to 12, in particular 6 to 8 carbon atoms and also m-xylylenediamine, di(4-aminophenyl)methane, di(4-aminocyclohexyl)methane, di(4-amino-3-methylcyclohexyl) methane, isophoronediamine, 1,5-diamino-2-methylpentane, 2,2-di(4-aminophenyl)propane or 2,2-di(4-aminocyclohexyl)propane.

Preferred polyamides are polyhexamethyleneadipamide (nylon 66, PA 66) and polyhexamethylenesebacamide (PA 610), polycaprolactam (nylon 6, PA 6) and polylaurolactam (PA 12). Also preferred are copolyamides PA 6/66, in particular comprising from 5% to 95% by weight of caprolactam units, and copolyamides PA 6/12, in particular comprising from 5% to 95% by weight of laurolactam units. PA 6, PA 66 and copolyamides 6/66 are particularly preferred; nylon 6 (PA 6) is very particularly preferred.

Further suitable polyamides are obtainable from w-aminoalkyl nitriles such as, for example, aminocapronitrile (PA 6) and adiponitrile with hexamethylenediamine (PA 66) by so-called direct chain-growth addition polymerization in the presence of water, as described for example in DE-A 10313681, EP-A 1198491 and EP-A 922065.

There may also be mentioned polyamides obtainable for example by condensation of 1,4-diaminobutane with adipic acid at elevated temperature (nylon-4,6). Methods of making polyamides of this structure are described for example in EP-A 38 094, EP-A 38 582 and EP-A 39 524.

Further examples are polyamides obtainable by copolymerization of two or more of the aforementioned monomers, or mixtures of two or more polyamides, in which case the mixing ratio is freely chooseable.

Such partly aromatic copolyamides as PA 6/6T and PA 66/6T whose triamine content is less than 0.5% and preferably less than 0.3% by weight (see EP-A 299 444) will also be found particularly advantageous. The production of partly aromatic copolyamides having a low triamine content can be carried out by following the processes described in EP-A 129 195 and 129 196.

The following, nonconclusive schedule comprises the polyamides mentioned and also further polyamides A within the meaning of the invention (the monomers are reported between parentheses):

AB polymers:
PA 6ε-caprolactam
PA 7 ethanolactam
PA 8 caprylolactam
PA 9 9-aminopelargonic acid
PA 11 11-aminoundecanoic acid
PA 12 laurolactam
AA/BB polymers:
PA 46 tetramethylenediamine, adipic acid
PA 66 hexamethylenediamine, adipic acid
PA 69 hexamethylenediamine, azelaic acid
PA 610 hexamethylenediamine, sebacic acid
PA 612 hexamethylenediamine, decanedicarboxylic acid
PA 613 hexamethylenediamine, undecanedicarboxylic acid
PA 1212 1,12-dodecanediamine, decanedicarboxylic acid
PA 1313 1,13-diaminotridecane, undecanedicarboxylic acid
PA 6T hexamethylenediamine, terephthalic acid
PA MXD6 m-xylylenediamine, adipic acid
PA 6I hexamethylenediamine, isophthalic acid
PA 6-3-T trimethylhexamethylenediamine, terephthalic acid
PA 6/6T (see PA 6 and PA 6T)
PA 6/66 (see PA 6 and PA 66)
PA 6/12 (see PA 6 and PA 12)
PA 66/6/610 (see PA 66, PA 6 and PA 610)
PA 6I/6T (see PA 61 and PA 6T)
PA PACM 12 diaminodicyclohexylmethane, laurolactam
PA 6I/6T/PACM like PA 6I/6T+diaminodicyclohexylmethane
PA 12/MACMI laurolactam, dimethyldiaminodicyclohexylmethane, isophthalic acid
PA 12/MACMT laurolactam, dimethyldiaminodicyclohexylmethane, terephthalic acid
PA PDA-T phenylenediamine, terephthalic acid These polyamides A and their preparation are known, for example from Ullmanns Encyklopädie der Technischen Chemie, 4th edition, Volume 19, pages 39-54, Verlag Chemie, Weinheim 1980; Ullmanns Encyclopedia of Industrial Chemistry, Vol. A21, pages 179-206, VCH Verlag, Weinheim 1992; Stoeckhert, Kunststofflexikon, 8th edition, pages 425-428, Carl Hanser Verlag Munich 1992 (headword "Polyamide" and following), and also Saechtling, Kunststoff-Taschenbuch, 27th edition, Carl Hanser-Verlag Munich 1998, pages 465-478.

The polyamides are preferably prepared in a customary manner by hydrolytic or activated anionic chain-growth addition polymerization of the monomers in batch or continuous apparatus, for example autoclaves or VK tubes. The residual content of monomers and/or oligomers can optionally be removed by vacuum distillation of the polyamide melt or by extraction, with hot water for example, of the chips formed from the polyamide melt.

Preference is given to hydrolytic chain-growth addition polymerization in an autoclave or one- to three-stage VK tubes with subsequent extraction of the residual monomers with water in the range 95 to 130° C. and drying in a shaft dryer with N2 or in a tumbler dryer under vacuum. The commonly used processes will be known to those skilled in the art and are described in their principles in the relevant literature, for example in cited Ullmanns Encyclopedia or in Kirk-Othmer, Encyclopedia of Chemical Technology, John Wiley and Sons, New York 2004.

Solid-state postcondensation of the polyamide chips at temperatures of 1 to 100° C., preferably 5 to 50° C., below the melting point of the polyamide can be used to raise the relative viscosity to the desired final value.

If necessary, the polyamide can be dried down to a residual moisture content of for example 0.001% to 0.2% by weight before it is processed to form the molding composition which is in accordance with the present invention.

The novel dyeable particles comprise one or more inorganic oxides having an average particle size (particle diameter) of 0.1 to 900 nm, preferably 1 to 500 nm, more preferably 3 to 250 nm, especially 5 to 100 nm and substances, chemically attached to the particles, which endow the particle and the polymer containing the particles with particular properties, examples being piperidine derivatives, to control the dyeability of the polymer and to stabilize the polymer against degradation by UV light or thermal oxidation.

Useful inorganic oxides include $SiO_2$, ZnO, $Al_2O_3$, AlOOH, $TiO_2$, $ZrO_2$, $CeO_2$, $Fe_2O_3$, $Fe_3O_4$, $In_2O_3$, $SnO_2$, MgO, preferably $SiO_2$, ZnO, $Al_2O_3$, $TiO_2$, $ZrO_2$, and more preferably $SiO_2$.

It is further possible to use mixed oxides such as $BaTiO_3$ or any desired mixed oxides composed of the abovementioned metal oxides in any desired composition. It is also possible to use shell-core particles such as, for example $SiO_2$/ZnO or $SiO_2/TiO_2$.

Useful added substances for functionalizing the particle surface include all compounds which are capable of endowing the particle and/or the polymer with special functionality (dyeability, UV protection, stabilization to heat/light exposure, flame retardancy, etc.) and can be chemically attached to the surface via a reactive group. Suitable reactive groups for attachment to the surface are in particular those which can react with the OH groups on the surfaces of the inorganic oxides, i.e., for example alkoxysilanes, silanols, silyl halides, carboxylic acids, phosphates, phosphonates, amines, etc., preferably alkoxysilanes, phosphates and phosphonates more preferably alkoxysilanes.

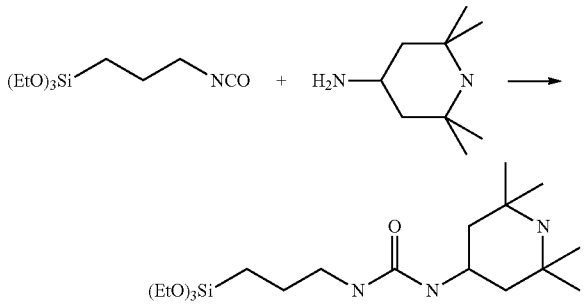

Further simple silanes could be:

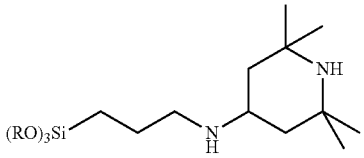

from the halide
(3-bromopropyl)trimethoxysilane

-continued

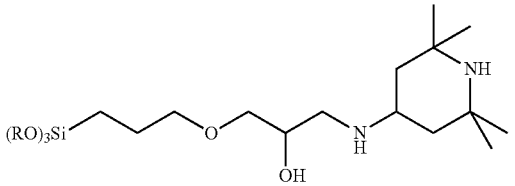

from the epoxide
e.g. (3-glycidoxypropyl)trimethoxysilane

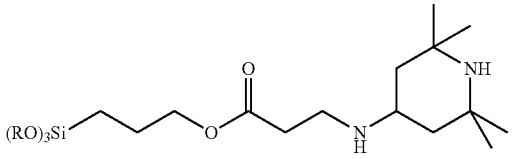

from the acrylate or methacrylate
e.g. methacryloyloxypropyltris(methoxy)silanes

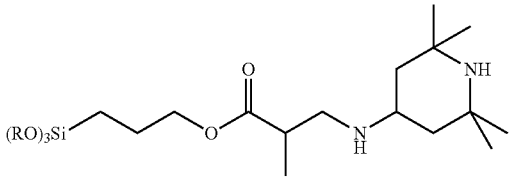

R = Me, Et, ...

sterically hindered aminosilanes (commercial):

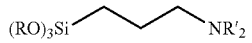

R′ = —Me, —Et, —EtOH

It is further possible to surface modify the particles with 2 or more different reagents. The abovementioned silanes can be combined in any desired mixing ratios or be used in combination with one or more other silanes.

The hindered piperidine derivative is preferably an aminopolyalkylpiperidine. Exemplary hindered piperidine derivatives include:

4-amino-2,2',6,6'-tetramethylpiperidine (TAD);
4-(aminoalkyl)-2,2',6,6'-tetramethylpiperidine;
4-(aminoaryl)-2,2',6,6'-tetramethylpiperidine;
4-(aminoaryl/alkyl)-2,2',6,6'-tetramethylpiperidine;
3-amino-2,2',6,6'-tetramethylpiperidine;
3-(aminoalkyl)-2,2',6,6'-tetramethylpiperidine;
3-(aminoaryl)-2,2',6,6'-tetramethylpiperidine;
3-(aminoaryl/alkyl)-2,2',6,6'-tetramethylpiperidine;
2,2',6,6'-tetramethyl-4-piperidine;
2,2',6,6'-tetramethyl-4-piperidinealkylcarboxylic acid;
2,2',6,6'-tetramethyl-4-piperidinearylcarboxylic acid;
2,2',6,6'-tetramethyl-4-piperidinealkyl/arylcarboxylic acid;
2,2',6,6'-tetramethyl-3-piperidinecarboxylic acid;
2,2',6,6'-tetramethyl-3-piperidinealkylcarboxylic acid;
2,2',6,6'-tetramethyl-3-piperidinearylcarboxylic acid;
2,2',6,6'-tetramethyl-3-piperidinealkyl/arylcarboxylic acid;
4-amino-1,2,2',6,6'-pentamethylpiperidine;
4-(aminoalkyl)-1,2,2',6,6'-pentamethylpiperidine;
4-(aminoaryl)-1,2,2',6,6'-pentamethylpiperidine;
4-(aminoaryl/alkyl)-1,2,2',6,6'-pentamethylpiperidine;
3-amino-1,2,2',6,6'-pentamethylpiperidine;
3-(aminoalkyl)-1,2,2',6,6'-pentamethylpiperidine;
3-(aminoaryl)-1,2,2',6,6'-pentamethylpiperidine;
3-(aminoaryl/alkyl)-1,2,2',6,6'-pentamethylpiperidine;
1,2,2',6,6'-pentamethyl-4-piperidinecarboxylic acid;
1,2,2',6,6'-pentamethyl-4-piperidinealkylcarboxylic acid;
1,2,2',6,6'-pentamethyl-4-piperidinearylcarboxylic acid;
1,2,2',6,6'-pentamethyl-4-piperidinealkyl/arylcarboxylic acid;
1,2,2',6,6'-pentamethyl-3-piperidinecarboxylic acid;
1,2,2',6,6'-pentamethyl-3-piperidinealkylcarboxylic acid;
1,2,2',6,6'-pentamethyl-3-piperidinearylcarboxylic acid; and
1,2,2',6,6'-pentamethyl-3-piperidinealkyl/arylcarboxylic acid.

Most preferably, the hindered piperidine derivative is 4-amino-2,2',6,6'-tetramethylpiperidine or 4-amino-1,2,2',6,6'-pentamethylpiperidine.

The dyeable particles can be combined with conventional chain regulators in the polymer-producing process (for example with mono- and dicarboxylic acids, for example acetic acid, propionic acid or adipic acid, and mono- and dialkylamines, for example hexamethylenediamine and benzylamine).

The chain-growth addition polymerization can be carried out in accordance with the conventional conditions for the polyamide condensation polymerization (see above), from the corresponding monomers and by admixing the functionalized particle into the monomer or into the reaction mixture as it undergoes chain-growth addition polymerization.

The addition or condensation polymerization of the starting monomers in the presence of compound (I) is preferably carried out by following the customary processes. For instance, the chain-growth addition polymerization of caprolactam in the presence of a compound (I) can be carried out for example by following the continuous or batch processes described in DE-A 14 95 198, DE-A 25 58 480, DE-A 44 13 177, Polymerization Processes, Interscience, New York, 1977, pages 424-467 and Handbuch der Technischen Polymerchemie, VCH Verlagsgesellschaft, Weinheim, 1993, pages 546-554. The addition polymerization of 66 salt in the presence of a compound (I) can be carried out by following the customary batch process (see: Polymerization Processes, Interscience, New York, 1977, pages 424-467, and especially 444-446) or by following a continuous process, for example as described in EP-A 129 196. In principle, compound (I) and starting monomers can be fed to the reactor separately or as a mixture. Preferably, compound (I) is added according to a predetermined amount-time program.

In a preferred embodiment of the present invention, compound (I) is combined with at least one of the customary chain regulators. Useful chain regulators include for example aliphatic and aromatic monocarboxylic acids such as acetic acid, propionic acid and benzoic acid, aliphatic and aromatic dicarboxylic acids such as $C_4$-$C_{10}$-alkanedicarboxylic acids, preferably sebacic acid and dodecanedioic acid, particularly adipic acid and azelaic acid, aliphatic $C_5$-$C_8$-cycloalkanedicarboxylic acids, particularly cyclohexane-1,4-dicarboxylic acid, aromatic dicarboxylic acids such as benzene and naphthalenedicarboxylic acids, preferably isophthalic acid, 2,6-naphthalenedicarboxylic acid, particularly terephthalic acid, monofunctional amines and bifunctional amines, preferably hexamethylenediamine or cyclohexyldiamine and also mixtures of such acids and mixtures of such amines. The chain regulator combination and the amounts used here are chosen according to the desired polymer properties, such as viscosity or end group content, among other considerations. When dicarboxylic acids are used as chain regulators, the chain regulators are preferably used in an amount of 0.06 to 0.6 mol %, preferably 0.1 to 0.5 mol %, all based on 1 mol of acid amide group of the polyamide.

In another preferred embodiment, the addition or condensation polymerization of the process of the present invention is carried out in the presence of at least one pigment. Preferred pigments are titanium dioxide, which is preferably in the anatase form, or colored compounds that are organic or inorganic in nature. The pigments are preferably added in an amount of 0 to 5 parts by weight, in particular 0.02 to 2 parts by weight, all based on 100 parts by weight of polyamide. The pigments can be fed to the reactor together with the starting materials or separately therefrom. The use of a compound (I) (including as a chain regulator constituent) has the effect of distinctly improving the properties of the polymer compared with a polymer containing just pigment and no compound (I) or just pigment and one of the aforementioned 2,2,6,6-tetramethylpiperidine derivatives.

The polyamides of the present invention are advantageous for use in the manufacture of filaments, fibers, self-supporting films/sheets, sheetlike structures and molded articles. Of particular advantage are filaments obtained from polyamides, particularly polycaprolactam, by high-speed spinning at withdrawal speeds of at least 4000 m/min. The filaments, fibers, self-supporting films/sheets, sheetlike structures and molded articles obtained by using the polyamides of the present invention may have many different uses, for example as textile apparel or carpet fibers.

Examples: PA Addition Polymerization with Functionalized Particles

The particle-monomer mixtures were mixed with further CPL and adjusted to the target concentration of particle-bound TAD and amino end groups (AEG). The target concentration of particle-bound TAD was 15-20 mmol/kg of PA (corresponding to an $SiO_2$ particle content of about 1.5% to 2%) in most cases; in some cases, higher concentrations of about 30 and 60 mmol/kg (corresponding to an $SiO_2$ particle content of about 3% and 6%) were set. Subsequently, the isopropanol present was distilled off, water was added for the CPL ring opening, and the addition polymerization at 15 bar pressure, 260° C. melt temperature and 2 h melt residence time.

The polymerization series and the characterization of the polymers obtained are detailed hereinbelow.

PA addition polymerization in unstirred autoclave

Preparation of Polymers 3 mixtures polymerized together in one autoclave run (3 installable glass containers)

a.) 50 g CPL+10 g $H_2O$ b.) 50 g CPL+10 g $H_2O$+particles for 15 mmol TAD (amount see table)

c.) 50 g CPL+10 g $H_2O$+particles for 30 mmol TAD (amount see table)

Before the samples were put into the autoclave, the starting materials were mixed and heated to about 55° C., forming a clear, homogeneous solution.

The autoclave has an internal volume of about 2 l. For each run, three glass vessels open at the top and each about 100 ml in volume and containing the reaction mixtures (50 g per sample in each case) are placed in the autoclave.

After nitrogen purging, the autoclave is sealed and heated up to 280° C. external temperature (about 270° C. internal temperature). After reaching about 0.5 bar internal pressure, the reactor was briefly depressurized to remove the isopropanol present. After further heating during about 1 h at 270° C. internal temperature, a pressure of about 14 bar becomes established. This pressure and temperature were kept at constant for 1 h. Then, the pressure is reduced (at a continuing internal temperature of 270° C.) to ambient pressure over 1 h. Subsequently, a postcondensation is carried out for 1.5 h under a 20 l/h nitrogen stream and atmospheric pressure. Then, 3 bar nitrogen is injected once more and the heating is switched off, so that the autoclave cools down to ambient temperature (about 20° C.), which takes about 5 h. The polymer samples are removed and the polymer is ground to form coarse granules.

Chemical base data

| | Additive quantity | | | | | |
|---|---|---|---|---|---|---|
| Experiment No. | Mixture (b) [g] | [mmol of TAD/kg of CPL] | $SiO_2$ solids content in PA (theoretical) [% m/m] | End group content [mmol/kg] | | RV [ ] |
| 1 | 0 | 0 | 0 | 56 | 54 | 2.44 |
| 2 | 5.3 | 15 | 1.3 | 47 | 91 | 2.21 |
| 3 | 10.6 | 30 | 2.6 | 46 | 128 | 2.09 |

Result:

The particle additization greatly increases the number of amino end groups.

Microscopic examination of thin sections of the polymerization products shows the nanoparticles to be uniformly dispersed and not to form agglomerates.

PA chain-growth polymerization in 10 liter stirred tank 4 batches were polymerized in succession in a stirred tank under approximately identical conditions.

a.) unregulated Standard PA6 (4000 g of CPL+400 g of $H_2O$)

b.) PA6 with about 17 mmol of TAD/kg of PA6 (batch as under a., but additionally with 17 mmol of TAD/kg)

c.) PA6 with about 15 mmol of particle-attached TAD/kg of PA6 (batch as under a., but additionally with 15 mmol of TAD attached to $SiO_2$ particles, /kg)

d.) PA6 with same particle quantity as under c.) but without functionalization of the particles.

The tank comprises a 10 liter pressure-resistant double-shell metal tank with installed stirrer and with heating and a bottom discharge valve.

Before the samples were placed in the stirred tank, the starting materials were mixed, heated to about 55° C., to form a clear, homogeneous solution.

After the starting materials had been put into the tank, the tank was repeatedly purged with nitrogen, then sealed and heated up to 280° C. external temperature (about 270° C. internal temperature) (after reaching about 0.5 bar internal pressure, the reactor was briefly depressurized, to remove the isopropanol present) (at 280° C. a pressure of about 14 bar becomes established thereafter). The reaction is continued at about 270° C. internal temperature and about 14 bar pressure. The pressure is then let down during about 1 h to ambient pressure at a continued internal temperature of about 270° C. This is followed by 70-80 min (see table) postcondensation at 20 l/h nitrogen purge under atmospheric pressure. Finally, the polymer is extruded from the reactor under a positive nitrogen pressure and cut into chips and dried.

Chips data

| Experiment No. | Comment | Additive quantity [mmol of TAD/kg of CPL] | Additive quantity $SiO_2$ solids content in PA (theoretical) [% m/m] | Postcondensation time [min] | Calcination residue [%] | RV [ ] | CEG [mmol/kg] | AEG [mmol/kg] |
|---|---|---|---|---|---|---|---|---|
| 4 | unregulated standard PA6 | 0 | 0 | 70 | 0 | 2.43 | 64 | 60 |
| 5 | PA6 with TAD regulated | 17 | 0 | 80 | 0 | 2.57 | 53 | 73 |
| 6 | PA6 with functionalized nanoparticles | 15 | 1.3 | 75 | 1.3 | 2.42 | 48 | 87 |
| 7 | PA6 with unfunctionalized nanoparticles | 0 | 3.2 | 75 | 2.9 | 2.41 | 77 | 72 |

CEG = Carboxyl End Group

Result:

The particle additization greatly increases the number of amino end groups.

Microscopic examination of thin sections of the polymerization products shows the functionalized nanoparticles to be uniformly dispersed and not to form agglomerates. By contrast, the same nanoparticles without functionalization form numerous large agglomerates (agglomerate size: about 100-300 nm) in the polymer.

Fiber Spinning Example

The dried chips (water content<0.06%) were spun in a conventional spinning system to form fibers. To this end, the chip polymer was filled into the heatable cylinder of the spinning system and heated up to about 230-240° C. A plunger was then used to press the melt through a spinneret die (7-hole spinneret die, die capillary diameter 0.25 mm). The liquid-melt filaments were cooled with a stream of quench air, wetted with liquid spin finish by passing through a spin finish yarn guide, and subsequently further advanced over unheated godets (one mono godet and two duo godets) and finally wound up. The different relative travelling speeds of the godets ensured that the yarn was drawn to a draw ratio of 2.5:1. The conditions are detailed in the table below.

Spinning up of samples/012-/013 on plunger type spinning system ILOY + cold drawing, 100 dtex 7 filaments Spinning conditions

| Material | | Test No. 6 TAD-functionalized nanoparticles | Test No. 5 no particles, conventionally regulated with TAD |
|---|---|---|---|
| Die | | 7 holes, Ø 0.25 | |
| Fill | | about 100 ml of chips | about 100 ml of chips |
| Test number | | V4 | V2 |
| Cylinder heater 1 | [° C.] | 236 | 240 |
| Cylinder heater 2 | [° C.] | 243 | 241-242 |
| Melting pressure | [bar] | 20 | 20-21 |
| Melt temperature | [° C.] | 236 | 233 |
| Plunger drive | [$cm^3$/min] | 0.5 | 0.5 |
| Quench air | [kPa] | 2 | 2 |
| Spin finish | [rpm] | 6 | 6.0 |
| Mono 1 | [m/min] | 20 | 20.0 |
| Duo 1 | [m/min] | 40 | 40.1 |
| Duo 2 | [m/min] | 49.9 | 50.1 |
| Fiber test results | | | |
| Linear density | dtex | 99.1 | 99.2 |
| Elongation | % | 118 | 120 |

-continued

Spinning up of samples/012-/013 on plunger type spinning system ILOY + cold drawing, 100 dtex 7 filaments Spinning conditions

| | | | |
|---|---|---|---|
| Tenacity | cN/dtex | 2.04 | 2.08 |
| Dyeing with Isolan Black 2S-LD, 0.2% dye rel. to fiber mass | Determination of relative depth of shade with Colourflash reflectance measurement | | |
| Depth of shade, comparative dyeing | % | 100 | 61 |

Result:

The samples with the functionalized particles were easy to process into yarns.

The physical base yarn properties of the two materials (yarn tenacity, yarn elongation) were approximately the same for the two materials. As for the rest, the fibers with particles did not exhibit any abnormalities compared with standard PA fibers in respect of the mechanical properties. In relation to the relative depth of shade, the particle-additized fibers gave a distinctly greater depth of shade than the comparative product, prepared with an equivalent amount of TAD, although in this case the TAD was not attached to particles prior to the condensation polymerization but was added as free TAD to the condensation polymerization mixture together with the starting materials.

Microscopic examination of thin sections of the fibers shows the nanoparticles to be uniformly dispersed in the fibers and not to form agglomerates.

PA addition polymerization in 1 liter stirred tank (preparation of samples with increased particle content, about 3% and about 6% solids content, preparative conditions similar to the above stirred tank tests in 10 l stirred tank, see above)

| Chip data | | | | | | | |
|---|---|---|---|---|---|---|---|
| | Additive quantity | | | Post | | | |
| Experiment No. | [mmol of TAD/kg of CPL] | $SiO_2$ solids content in PA (theoretical) [% m/m] | Calcination residue [% m/m] | condensation time [min] | RV [ ] | CEG [mmol/kg] | AEG |
| 8 | 30 | 2.6 | 3.2 | 30 | 2.01 | 62 | 141 |
| 9 | 60 | 5.2 | 6.1 | 30 | 1.87 | 43 | 197 |

Even relatively high particle concentrations (2.6% and 5.2% solids content) can be incorporated into PA6.

Microscopic examination of thin sections of the fibers shows the nanoparticles to be uniformly dispersed in the fibers and not to form agglomerates.

The process of the present invention can be carried out as follows:

Production of polyamide fibers with dyeable particles:

The novel dyeable particles can be added to the monomer and addition polymerized in the presence of catalysts at a temperature of 10 to 200° C., preferably of 20 to 180° C., more preferably of 25 to 100° C. and a pressure of 0.01 to 10 bar, preferably of 0.1 to 5 bar and more preferably of 1 to 1.5 bar.

Production of Dyeable Particles:

A 4-aminopiperidine derivative can be reacted with a surface-active compound (for example alkoxy silanes, silanols, carboxylic acids, phosphates, phosphonates) which additionally possesses an electrophilic group (for example isocyanate, epoxy, halide, electron-deficient double bond, etc. . . . ) at a temperature of 0 to 300° C., preferably of 10 to 160° C., more preferably of 15 to 80° C. and a pressure of 0.2 to 100 bar, preferably of 0.7 to 5 bar, more preferably of 0.9 to 1.1 bar.

The reaction can be carried out in the presence of a solvent A. The amount of solvent can be varied within wide limits and is generally in the range from 0.1:1 to 1000:1, preferably in the range from 0.5:1 to 100:1 and particularly in the range from 1:1 to 50:1 based on the 4-aminopiperidine derivative. The reaction can essentially be carried out in the absence of a solvent, i.e., at 0.09:1 to 0.0001:1, preferably 0.05:1 to 0.001:1 based on the 4-aminopiperidine derivative, or in the absence of a solvent. The 4-aminopiperidine derivative is not a solvent for the purposes of this invention.

Examples of suitable solvents A are ethanol, 1-propanol, 2-propanol, 1-butanol, 2-butanol, 2-methyl-2-propanol, 1-chloro-2-propanol, cyclopentanol, cyclohexanol, 1,4-dioxane, tetrahydrofuran, 1-methoxy-2-propanol, 1-ethoxy-2-propanol, 2-ethoxyethanol, 2-methyl-2-propanol, 2-methoxyethanol, dimethylformamide, acetonitrile, acetone, methyl ethyl ketone, dichloromethane, chloroform, dimethyl sulfoxide, toluene, xylene, nitrobenzene, chlorobenzene, pyridine, diethyl ether, tert-butyl methyl ether, hexane, heptane, petroleum ether, cyclohexane, N-methyl-2-pyrrolidone, ethyl acetate.

The product formed and/or other surface-active compounds can be reacted with one or more oxides at a temperature of 0 to 300° C., preferably 10 to 160° C., more preferably 20 to 85° C. and a pressure of 0.2 to 100 bar, preferably 0.7 to 5 bar, more preferably 0.9 to 1.1 bar.

Aqueous metal oxide dispersions are preferably used, more preferably aqueous silica dispersions. The content of silica, reckoned as SiO2, is in the range from 10% to 60% by weight, preferably in the range from 20% to 55% and more preferably in the range from 25% to 40% by weight. It is also possible to use silica sols having a lower content, but in that case the extra content of water has to be distilled off in a later step.

To functionalize the surface of the SiO2 nanoparticles, the slightly acid solution obtained can be admixed with 0 to 10 times, preferably 0.2 to 5 times, more preferably 0.4 to 3 times and most preferably 0.5 to 2 times the amount of water (based on the amount of silica sol used) and with 0.1 to 20 times, preferably 0.3 to 10 times, more preferably 0.5 to 5 times and most preferably 1 to 3 times the amount (based on the amount of the silica sol used) of at least one organic solvent B. It is a preferred embodiment not to add additional water.

When an aqueous metal oxide dispersion is used, the organic solvent is selected according to the following criteria: the solvent should have sufficient miscibility with water and some miscibility with the caprolactam under the conditions of mixing.

The miscibility with water under the reaction conditions should be at least 20% by weight (based on the final water-solvent mixture), preferably at least 50% by weight and more preferably at least 80% by weight. When miscibility is too low, there is a risk that the modified silica sol will form a gel or comparatively large nanoparticle aggregates will floc out.

Said solvent B should further have a boiling point of less than 80° C. in a pressure range extending from atmospheric pressure to 50 hPa, so that it is simple to separate off by distillation.

In a preferred embodiment, solvent B combines with water under distillation conditions to form an azeotrope or heteroazeotrope, so that the distillate obtained after the distillation forms an aqueous and an organic phase.

Examples of suitable solvents B are ethanol, 1-propanol, 2-propanol, 1-butanol, 2-butanol, 2-methyl-2-propanol, 1-chloro-2-propanol, cyclopentanol, cyclohexanol, 1,4-dioxane, tetrahydrofuran, 1-methoxy-2-propanol, 1-ethoxy-2-propanol, 2-ethoxyethanol, 2-methyl-2-propanol, 2-methoxyethanol, dimethylformamide, acetonitrile and acetone.

When the system formed is present in a solvent mixture of water and solvent B, the sol is concentrated by distillation until the residual water content is below 30%, preferably below 20% and more preferably below 10%. It can be necessary for this purpose to add further solvent before the distillation or during the distillation.

The distillative removal of water and the organic solvent B is effected under atmospheric or reduced pressure, preferably at 10 hPa to atmospheric pressure, more preferably at 20 hPa to atmospheric pressure, even more preferably at 50 hPa to normal pressure and particularly at 100 hPa to normal pressure.

The temperature of distillation depends on the boiling temperature of water and/or organic solvent B at the particular pressure.

The sol obtained is subsequently diluted with caprolactam and solvent B. In one embodiment, it is also possible to use a sol having comparatively high residual water content, so that prior distillation can be dispensed with.

Water and solvent B are generally distilled off to such an extent that the content of functionalized silica particles is in the range from 0.1% to 80% by weight, preferably in the range from 1% to 60% and more preferably in the range from 5% to 50% by weight. The residual content of water in the final product should be less than 10% by weight, more preferably less than 5%, more preferably less than 2%, even more preferably less than 1%, particularly less than 0.5% and specifically less than 0.3% by weight. The residual content of solvent (L) in the final product should be less than 40% by weight, preferably less than 20%, more preferably less than 10%, even more preferably less than 3%, particularly less than 2% and specifically less than 1% by weight.

The present invention polyamide fibers with dyeable particles can be dyed with dyes, or mixtures thereof, by means of methods known per se.

EXAMPLES

Particle size was determined using a Zetasizer Nano S from Malvern. Since particle size was determined by dynamic light scattering (DLS) and reflects the hydrodynamic radius, the actual particle size is below the measured values.

Example 1

Preparation of 4-aminopiperidine derivative

Preparation of N-(2,2,6,6-tetramethyl-4-piperidinyl)-N'-[3-(triethoxysilyl)propyl]urea 59.5 g (0.228 mol) of isocyanatopropyltriethoxysilane were initially charged in 50 ml of dichloromethane (abs.) and admixed with 35.63 g (0.228 mol) of 4-amino-2,2,6,6-tetramethylpiperidine in 30 ml of dichloromethane by dropwise addition at 20-40° C. and stirring for 18 h. Removal of the solvent in vacuo left 97.62 g of N-(2,2,6,6-tetramethyl-4-piperidinyl)-N'-[3-(triethoxysilyl)propyl]urea with residual traces of solvent as a colorless oil. The product was characterized using 1H NMR.

Example 2

Preparation of Dyeable Particles

Preparation of N-(2,2,6,6-tetramethyl-4-piperidinyl)-N'-[3-(triethoxysilyl)propyl]urea-attached $SiO_2$ [hereafter referred to as PSH—$SiO_2$]

In a glass beaker, 1000 g of a basic silica sol having an $SiO_2$ solids content of 30% by weight and an average particle size of 15 nm (Levasil®200, HCStark GmbH, Leverkusen, Germany) were admixed with 100 g of a strong acidic cation exchanger (Amberjet®1200(H), Sigma Aldrich Chemie GmbH, Taufkirchen, Germany) followed by 30 minutes of stirring at room temperature, during which a pH of 2.3 became established, and the ion exchanger was subsequently removed by filtration.

To 361 g of this aqueous sol having an $SiO_2$ content of 30% by weight [108.3 g] were added 361 ml of isopropanol. Addition of 48.4 g (0.120 mol) of N-(2,2,6,6-tetramethyl-4-piperidinyl)-N'-[3-(triethoxysilyl)propyl]urea was followed by stirring at RT for 24 hours. After addition of 1800 ml of isopropanol, the sol was concentrated to 390 g at 50° C. under reduced pressure (residual water content: 3.1%).

Example 3

Incorporation of Dyeable Particles in the Addition Polymerization Monomer

The sol of Example 2 was subsequently added dropwise to a solution of 400 g of caprolactam and 400 g of isopropanol, and the mixture was concentrated to 675 g at 50° C. and reduced pressure. A clear dispersion of an N-(2,2,6,6-tetramethyl-4-piperidinyl)-N'-[3-(triethoxysilyl)propyl]urea-attached $SiO_2$ having an average particle size of 68 nm (residual water content: 0.7%) was obtained.

Example 3a

Stability test of Example 2 dispersion of an N-(2,2,6,6-tetramethyl-4-piperidinyl)-N'[3-(triethoxysilyl)propyl]urea-attached $SiO_2$ The residual solvent from 10 g of the clear dispersion of Example 2 having an average particle size of 68 nm was removed by distillation. After cooling, 8.17 g of a solid material (about 28% by weight of functionalized $SiO_2$ in caprolactam) were obtained. After heating to 120° C., a transparent dispersion was again obtained. The particle size remained a constant 68 nm even after 5 hours at 120° C.

The result showed that the dispersion was stable under these conditions.

We claim:

1. Polyamide fibers with dyeable particles comprising 80% to 99.95% by weight of polyamide, 0.05% to 20% by weight of dyeable particles and 0% to 19.95% by weight of added substances, the percent by weight not exceeding 100%, wherein the dyeable particles comprise one or more inorganic oxides having an average particle size of 0.1 to 900 nm, and a piperidine derivative with an alkoxysilane group is chemically attached to the one or more oxides via the alkoxysilane group.

2. The fibers as claimed in claim 1, wherein said one or more inorganic oxides-have an average particle size of 1 to 500 nm.

3. The fibers as claimed in claim 1, wherein said one or more inorganic oxides-have an average particle size of 3 to 250 nm.

4. The fibers as claimed in claim 1, wherein said one or more inorganic oxides-have an average particle size of 5 to 100 nm.

5. The fibers as claimed in claim 1, wherein said polyamide is polyhexamethyleneadipamide (nylon 66, PA 66), polyhexamethylenesebacamide (PA 610), polycaprolactam (nylon 6, PA 6) or polylaurolactam (PA 12).

6. The fibers as claimed in claim 4, wherein said polyamide is polyhexamethyleneadipamide (nylon 66, PA 66), polyhexamethylenesebacamide (PA 610), polycaprolactam (nylon 6, PA 6) or polylaurolactam (PA 12).

7. The fibers as claimed in claim 1, wherein said polyamide are copolyamides PA 6/66.

8. The fibers as claimed in claim 7, wherein said polyamides comprises from 5% to 95% by weight of caprolactam units and copolyamides PA 6/12.

9. The fibers as claimed in claim 7, wherein said polyamides comprises from 5% to 95% by weight of laurolactam units.

10. The fibers as claimed in claim 7, wherein said_polyamides comprises from 5% to 95% by weight of PA6, PA66 or copolyamides PA6/66.

11. The fibers as claimed in claim 7, wherein said polyamides comprises from 5% to 95% by weight of PA 6.

12. The fibers as claimed in claim 2, wherein the piperidine derivative includes a hindered piperidine group selected from the group consisting of: 4-amino-2,2',6,6'-tetramethylpiperidine; 4-(aminoalkyl)-2,2',6,6'-tetramethylpiperidine; 4-(aminoaryl)-2,2',6,6'-tetramethylpiperidine; 4-(aminoaryl/alkyl)-2,2',6,6'-tetramethylpiperidine; 3-amino-2,2',6,6'-tetramethylpiperidine; 3-(aminoalkyl)-2,2',6,6'-tetramethylpiperidine; 3-(aminoaryl)-2,2',6,6'-tetramethylpiperidine; 3-(aminoaryl/alkyl)-2,2',6,6'-tetramethylpiperidine; 2,2',6,6'-tetramethyl-4-piperidinecarboxylic acid; 2,2',6,6'-tetramethyl-4-piperidinealkylcarboxylic acid; 2,2',6,6'-tetramethyl-4-piperidinearylcarboxylic acid; 2,2',6,6'-tetramethyl-4-piperidinealkyl/arylcarboxylic acid; 2,2',6,6'-tetramethyl-3-piperidinecarboxylic acid; 2,2',6,6'-tetramethyl-3-piperidinealkylcarboxylic acid; 2,2',6,6'-tetramethyl-3-piperidinearylcarboxylic acid; 2,2',6,6'-tetrainethyl-3-piperidinealkyl/arylcarboxylic acid; 4-amino-1,2,2',6,6'-pentamethylpiperidine; 4-(aminoalkyl)-1,2,2',6,6'-pentamethylpiperidine; 4-(aminoaryl)-1,2,2',6,6'-pentamethylpiperidine; 4-(aminoaryl/alkyl)-1,2,2',6,6'-pentamethylpiperidine; 3-amino-1,2,2',6,6'-pentamethylpiperidine; 3-(aminoalkyl)-1,2,2',6,6'-pentamethylpiperidine; 3-(aminoaryl)-1,2,2',6,6'-pentamethylpiperidine; 3-(aminoaryl/alkyl)-1,2,2',6,6'-pentamethylpiperidine; 1,2,2',6,6'-pentamethyl-4-piperidinecarboxylic acid; 1,2,2',6,6'-pentamethyl-4-piperidinealkylcarboxylic acid; 1,2,2',6,6'-pentamethyl-4-piperidinearylcarboxylic acid; 1,2,2',6,6'-pentamethyl-4-piperidinealkyl/arylcarboxylic acid; 1,2,2',6,6'-pentamethyl-3-piperidinecarboxylic acid; 1,2,2',6,6'-pentamethyl-3-piperidinealkylcarboxylic acid; 1,2,2',6,6'-pentamethyl-3-piperidinearylcarboxylic acid; and 1,2,2',6,6'-pentamethyl-3-piperidinealkyl/arylcarboxylic acid.

13. The fibers as claimed in claim 1, wherein the piperidine derivative includes a hindered piperidine group selected from the group consisting of 4-amino-2,2',6,6'-tetramethylpiperidine, and 4-amino-1,2,2',6,6'-pentamethylpiperidine.

14. Polyamide fibers comprising:

80% to 99.95% by weight of polyamide selected from the group consisting of polyhexamethyleneadipamide (nylon 66, PA 66), polyhexamethylenesebacamide (PA 610), polycaprolactam (nylon 6, PA 6) and polylaurolactam (PA 12);

0. 05% to 20% by weight of dyeable particles; and

0% to 19.95% by weight of added substances, the percent by weight not exceeding 100% wherein the dyeable particles comprise one or more inorganic oxides having an average particle size of 5 to 100 nm, and a piperidine derivative with an alkoxysilane group is chemically attached to the one or more oxides via the alkoxysilane group.

* * * * *